United States Patent [19]

Poyner

[11] Patent Number: 4,692,656

[45] Date of Patent: Sep. 8, 1987

[54] MOTOR VEHICLE HEADLIGHT WITH SELF-CENTERING LUG ASSEMBLY

[75] Inventor: John C. Poyner, Seymour, Ind.

[73] Assignee: GTE Products Corporation, Danvers, Mass.

[21] Appl. No.: 835,023

[22] Filed: Feb. 28, 1986

[51] Int. Cl.[4] ..... H01K 1/18; H01K 1/40; H01K 1/44

[52] U.S. Cl. ..... 313/113; 313/331; 362/267

[58] Field of Search ..... 313/113, 315, 318, 331, 313/332; 362/267, 306, 308, 310, 83

[56] References Cited

U.S. PATENT DOCUMENTS 3,010,045 11/1961 Plagge et al. ..... 313/113
4,456,947 6/1984 Alexander ..... 313/113 X

*Primary Examiner*—David K. Moore
*Assistant Examiner*—K. Wieder
*Attorney, Agent, or Firm*—Lawrence R. Fraley

[57] ABSTRACT

A motor vehicle headlight is disclosed having a lug assembly with self-centering characteristics to facilitate alignment of the lug on the headlight reflector's boss.

4 Claims, 2 Drawing Figures

MOTOR VEHICLE HEADLIGHT WITH SELF-CENTERING LUG ASSEMBLY

TECHNICAL FIELD

The present invention relates in general to headlights such as those manufactured for automotive (motor vehicle) applications. More particularly, the present invention relates to an improved external contact lug that has a self-centering capability.

BACKGROUND

Representative examples of motor vehicle headlights are described in U.S. Pat. Nos. 4,146,812 (Gagnon) and 4,181,869 (B. Warren et al), both of which are assigned to the same assignee as the instant invention and were so assigned at the time the invention was made. In particular, in U.S. Pat. No. 4,181,869, there is disclosed a tungsten-halogen lamp sealed in a reflector envelope employing lead-in conductors (wires) which pass through the reflector and are adapted for being supported by an eyelet and associated lug member. The eyelet extends through an aperture in the glass reflector while the lug interconnects with the eyelet and is adapted to receive an electrical connector external of the reflector envelope.

During assembly of the eyelet and lug, it is very important to have the lugs kept within certain critical alignment or spacing. This is deemed necessary because the lugs, usually two or three in number, subsequently receive an external connector which is part of the vehicle's electrical system. In this assembly operation, a pedestal (or jig) has been typically fitted over the end of the eyelet and lug. A peening operation was then performed; that is, the outer edge of the eyelet was rolled over, securing the eyelet to the extension of the lug. After the pedestal was removed from the end of the eyelet, lugs have tended to shift toward the center of the reflector, causing the aforedescribed misalignment. In addition, during subsequent assembly operations, these lugs have also become loose. A further assembly operation was then necessary to re-orient the lugs and bring them back to the required spacing. This was usually accomplished by providing each of the lugs with an added locating spacer.

DISCLOSURE OF THE INVENTION

Accordingly, it is an object of the present invention to provide an improvement in the manufacture of motor vehicle headlights by providing an improved lug construction having a self-centering feature.

Another object of the present invention is to provide an improved motor vehicle headlight which can be manufactured with fewer operational steps while providing accurate lug spacing.

To accomplish the foregoing and other objects of this invention, there is provided a motor vehicle headlight which comprises an electric lamp, a glass reflector defining at least one opening therein for receiving a lead-in support wire adapted to connect to the electric lamp, and an external boss portion disposed about the opening. A metal eyelet extends through the reflector's opening and has an outer end portion extending above the boss portion. The lead-in support wire extends directly through the hollow metal eyelet. An external contact lug also has an aperture therein for receiving the outer end portion of the metal eyelet. In accordance with the invention, the base portion of the contact lug has means for centering the base portion within the reflector's opening during attachment of the eyelet to the lug, thereby assuring lug alignment. Lug alignment is further assured by provision of a raised area (shoulder) adjacent the boss portion and by positioning the lug such that it engages this raised area.

BEST MODE FOR CARRYING OUT THE INVENTION

For a better understanding of the present invention, together with other and further objects, advantages and capabilities thereof, reference is made to the following disclosure and appended claims in connection with the above described drawings.

Figure 1:
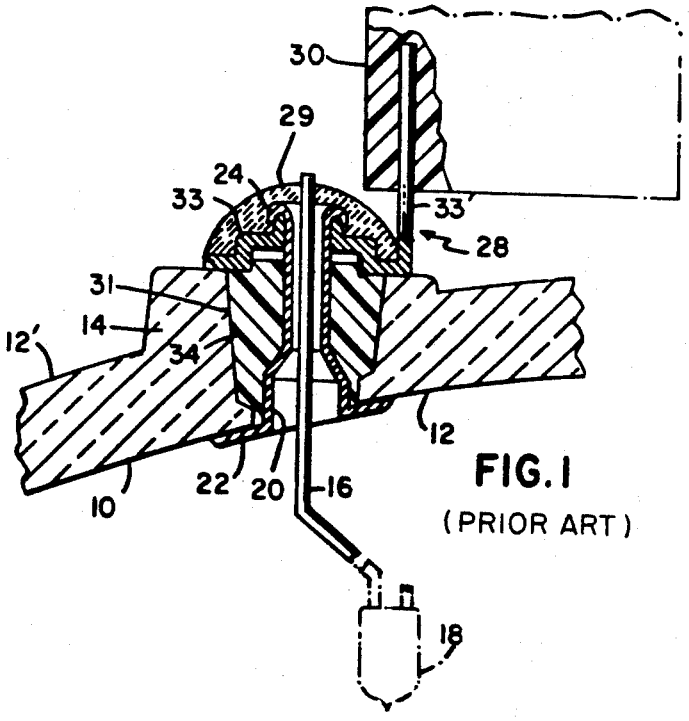
FIG. 1 (PRIOR ART)
FIG. 1 is a fragmentary, sectional view of a previous lug construction.
Figure 2:
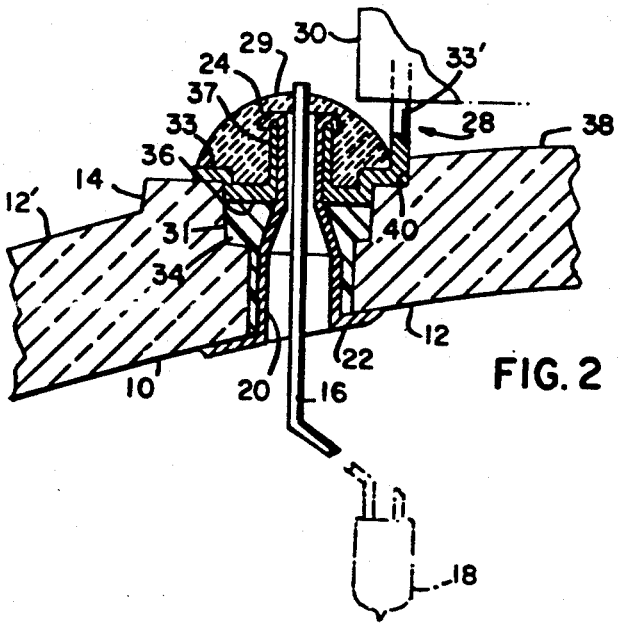
FIG. 2 is a similar, fragmentary sectional view of an improved lug construction according to the present invention.

A motor vehicle headlight in accordance with the present invention is shown in FIG. 2 of the drawing while in FIG. 1 there is shown a previous design. Because the two views are somewhat similar, like reference character numbers are used to identify like parts. The headlight is not shown in its entirety in FIGS. 1 and 2, but it may comprise a glass (or plastic) lens bonded to the front of the headlight's curved glass or plastic reflector 10. The drawing illustrates only a fragment of this glass reflector, which in turn includes an inner curved reflective surface 12 and an external boss portion 14 which extends above the reflector's external second surface 12'. In addition to glass reflector 10, FIGS. 1 and 2 also show the headlight's lead-in support wire 16 which extends through an opening 31 in the eyelet 20 and is connected to an electric lamp 18 (shown in phanton).

Support wire 16, as illustrated in FIGS. 1 and 2, may further include additional lead-in support wire elements not shown in the drawings.

As illustrated, opening 31 in the glass reflector extends from the boss portion 14 through the reflective surface 12. This opening receives a metal eyelet 20 having at its inner end an angled head section 22 which is of approximately the same contour as the curvature of surface 12 so as to lie flush thereagainst. The outer end portion 24 of eyelet 20 passes through an aperture in the base portion 33 of a contact lug 28, the open region surrounding the eyelet being filled with a suitable adhesive 34. The end of eyelet 20 is turned over (peened) so as to secure both the external contact lug 28 and the eyelet to the glass reflector. The eyelet is thus essentially riveted to the base portion of lug 28. Subsequently, a quantity of solder 29 is applied to connect the support wire and eyelet members, as well as to reinforce the positioning relationship between these members at this location.

The external contact lug 28 also includes an upstanding arm 33' which extends from the flat surface of boss 14 and is connected to an electrical connector 30, which, as stated, forms part of the motor vehicle's electrical system.

With particular reference to the previous embodiment shown in FIG. 1, base portion 33 comprises a raised, stepped portion. This raised portion in turn provides added containment space for excessive adhesive or epoxy 34, to thereby prevent charring and blackening during subsequent soldering. However, during fabrication of such a lamp, an assembly pedestal (not shown) was required to center the lugs to keep them in the required spaced alignment. When the pedestal was subsequently removed, the lugs tended to shift toward the center of the lamp, the result being that the required spacing was exceeded. To remedy this, an additional fabricating step (i.e., using locating spacers for the lugs) was necessary in order to compensate for the lug shift.

To assure this essential alignment, the base portion 33 of lug 28 in FIG. 2 is formed with an embossment 36 having an external dimension substantially similar to the interior dimension of opening 31 in reflector 10. Embossment 36 fits snugly into the opening and provides a covering for adhesive 34. Lug 28 is thus securedly positioned within reflector 10 and prevented from tilting or other lateral movement. Subsequent crimping of eyelet 24 over the lug's projecting central portion 37, which is cylindrical in shape and extends above base portion 33, is thus easily achieved without lug displacement. In addition, the lug is substantially prevented from movement during the adhesive curing and aforementioned soldering operation.

To further assure lug alignment, the rear (second) surface of reflector 10 is provided with a raised (or shoulder) area 38 which includes an indentation 40 or the like therein in which leg 33' is positioned. Movement of the lug (i.e., rotational, in the direction of the viewer in FIG. 2) is even further prevented by this arrangement wherein the lug positively engages the reflector.

Thus there has been provided an improved motor vehicle headlight wherein critical alignment of the headlight's contact lug members (i.e., relative to each other) is assured. The arrangement as defined herein can be fabricated expeditiously and without the need for additional procedures and/or components heretofore deemed essential.

While there have been shown and described what are considered the preferred embodiments of the invention, it is obvious that various modifications may be made herein without departing from the scope of the invention as defined by the following claims.

What is claimed is:

1. In a motor vehicle headlight including an electric lamp, a glass reflector defining at least one opening therein and having a first reflective surface for reflecting light from said electric lamp and a second external surface including a boss portion extending above said second surface and surrounding said opening, a metal eyelet positioned substantially within said opening and including an outer portion projecting above said boss portion, a quantity of adhesive located within said opening and surrounding said eyelet, an external contact lug having an upstanding leg portion and a base portion, said base portion having an aperture therein, said outer portion of said eyelet attached to said base portion of said contact lug, and a lead-in support wire extending within said aperture within said base portion of said contact lug for being electrically connected to said electric lamp, the improvement comprising means formed within said base portion of said contact lug for centering said base portion of said contact lug within said opening in said reflector to maintain said contact lug in a fixed orientation within said opening during said attachment of said eyelet to said contact lug, said centering means extending within said opening within said glass reflector in contact with the interior walls of said opening.

2. The improvement according to claim 1 wherein said base portion centering means comprises an embossment on said base portion of said contact lug, said embossment being snugly fit within said opening and encompassing said outer portion of said eyelet, said snug fit preventing lateral movement of said contact lug.

3. The improvement according to claim 1 wherein said second external surface of said reflector has a raised area abutting said boss portion and including an indentation therein, said upstanding leg portion of said contact lug being positioned within said indentation and engaging said raised area for preventing rotational movement of said contact lug.

4. The improvement according to claim 2 wherein said embossment provides a cover for said adhesive located within said opening and surrounding said eyelet.

* * * * *